US010857062B2

(12) United States Patent
Yoo et al.

(10) Patent No.: US 10,857,062 B2
(45) Date of Patent: Dec. 8, 2020

(54) SPRING BED DEVICE WITH HEATING FUNCTION

(71) Applicants: Seng Yeul Yoo, Seoul (KR); Ji Hyun You, Seoul (KR)

(72) Inventors: Seng Yeul Yoo, Seoul (KR); Ji Hyun You, Seoul (KR)

( * ) Notice: Subject to any disclaimer, the term of this patent is extended or adjusted under 35 U.S.C. 154(b) by 305 days.

(21) Appl. No.: 15/536,774

(22) PCT Filed: Dec. 15, 2015

(86) PCT No.: PCT/KR2015/013730
§ 371 (c)(1),
(2) Date: Jun. 16, 2017

(87) PCT Pub. No.: WO2016/099115
PCT Pub. Date: Jun. 23, 2016

(65) Prior Publication Data

US 2017/0348182 A1 Dec. 7, 2017

(30) Foreign Application Priority Data

Dec. 17, 2014 (KR) ..... 10-2014-0182690

(51) Int. Cl.
*A61H 15/02* (2006.01)
*A47C 21/04* (2006.01)
(Continued)

(52) U.S. Cl.
CPC ..... *A61H 15/02* (2013.01); *A47C 21/048* (2013.01); *A47C 27/04* (2013.01); *A47C 31/008* (2013.01);
(Continued)

(58) Field of Classification Search
CPC ..... A61H 15/02; A61H 15/00; A61H 2201/0146; A61H 2201/0207;
(Continued)

(56) References Cited

U.S. PATENT DOCUMENTS 2,493,067 A * 1/1950 Goldsmith ..... A47C 21/044 219/217
2,512,559 A * 6/1950 Williams ..... A47G 9/0215 219/212
(Continued)

FOREIGN PATENT DOCUMENTS

JP 2011-104215 A 6/2011
JP 2014-083208 A 5/2014
(Continued)

*Primary Examiner* — Nicholas F Polito
*Assistant Examiner* — Morgan J McClure
(74) *Attorney, Agent, or Firm* — Korus Patent, LLC; Seong Il Jeong

(57) ABSTRACT

There is provided a bed device comprising: a support plate; a spring mattress provided on the support plate; a mat provided on the spring mattress; and a hot-air supply device for supplying hot air into the spring mattress, wherein the hot-air supply device is received in the spring mattress, wherein the hot-air supply device includes: a hot-air generation unit for generating hot-air; a hot-air discharge tube protruding from the hot-air generation unit by a predetermined length to discharge the hot-air generated in the hot-air generation unit into the spring mattress; and two hot-air guide members symmetrically disposed about the hot-air discharge tube, wherein the two air guide members are configured to guide the hot-air such that the hot air discharged from the hot-air discharge tube is distributed uniformly over an entire area of the spring mattress.

7 Claims, 8 Drawing Sheets

(51) Int. Cl.

| | |
|---|---|
| ***A47C 27/04*** | (2006.01) |
| ***A47C 31/00*** | (2006.01) |
| ***A61H 15/00*** | (2006.01) |
| ***A47C 27/08*** | (2006.01) |
| ***A47C 27/10*** | (2006.01) |

(52) U.S. Cl.
CPC ..... *A47C 27/08* (2013.01); *A47C 27/10* (2013.01); *A61H 15/00* (2013.01); *A61H 2201/0146* (2013.01); *A61H 2201/025* (2013.01); *A61H 2201/0207* (2013.01); *A61H 2201/5023* (2013.01); *A61H 2201/5082* (2013.01)

(58) Field of Classification Search
CPC ..... A61H 2201/025; A61H 2201/5023; A61H 2201/5082; A47C 21/048; A47C 27/04; A47C 31/008; A47C 27/08; A47C 27/081; A47C 27/085; A47C 27/087; A47C 27/088; A47C 27/10
See application file for complete search history.

(56) References Cited

U.S. PATENT DOCUMENTS 3,220,020 A * 11/1965 Nelson ..... A61G 7/012 108/145
3,237,212 A * 3/1966 Hillenbrand ..... A47C 20/041 5/616
3,266,064 A * 8/1966 Figman ..... A47C 21/044 5/284
3,529,310 A * 9/1970 Giuseppe ..... A47C 7/74 297/180.13
3,595,223 A * 7/1971 Castagna ..... A61H 9/0078 5/713
4,934,493 A * 6/1990 Bauer ..... D06F 37/20 188/129
5,251,347 A * 10/1993 Hopper ..... A61F 7/00 5/284
6,957,454 B1 * 10/2005 Newton ..... A61F 7/007 5/421
7,165,281 B2 * 1/2007 Larssson ..... A47C 21/044 5/724
8,074,669 B2 * 12/2011 Collins ..... A47C 19/126 135/123
8,181,290 B2 * 5/2012 Brykalski ..... A47C 21/044 5/423
8,484,774 B2 * 7/2013 Cohen ..... A47C 19/045 5/11
8,915,478 B2 * 12/2014 Perez ..... A61G 1/04 248/178.1
9,689,579 B2 * 6/2017 Jung ..... F24F 3/1405
9,782,016 B2 * 10/2017 Aramli ..... A47C 21/048
10,047,981 B2 * 8/2018 Parish ..... F25B 21/02
2003/0028132 A1 * 2/2003 Bastia ..... A61H 23/0254 601/57
2011/0115635 A1 * 5/2011 Petrovski ..... A47C 21/044 340/584
2014/0271349 A1 * 9/2014 Gowda ..... A61L 9/20 422/4

FOREIGN PATENT DOCUMENTS

KR 10-0826793 B1 4/2008
KR 10-1073761 B1 10/2011
KR 20-2012-0007747 U 11/2012

* cited by examiner

SPRING BED DEVICE WITH HEATING FUNCTION

BACKGROUND

Field of the Present Disclosure

The present invention relates to a spring bed device with a heating function, and more particularly to a spring bed device including a spring mattress with hot air heating function and massage function.

Discussion of Related Art

In general, the spring mattress used in the bed device has no heating or cooling function, so there have been efforts to add heating or cooling functions thereto.

As part of that effort, a regular electric mattress is laid on the spring mattress, and a blanket is placed on it to add warmth. In this case, the soft cushion of the bed device could cause deformation of the electric mattress, resulting in damage to its heating line.

In addition, the hot stone type bed device has been developed, which has a heating line embedded therein. This has the advantage of providing the same effect as the traditional hot stone type floor. It is too hard to satisfy the user who seeks comfort.

On the other hand, a bed device has been developed that supplies warm air to the interior of a spring mattress, bringing warm air to the upper shell of the spring mattress. This is lower in terms of energy efficiency as compared with an electric mattress using general heating wires. There is also a disadvantage that only hot air is generated.

However, in this bed device of the prior art, the heating air blown from the hot air generation device does not concentrate on the upper shell of the spring mattress, but leaks to the front, rear, side and lower faces thereof. Therefore, it takes a long time to warm up the spring mattress. Also, since the hot air generation device is to be operated for a long time so that the spring mattress becomes warm, the thermal efficiency is low and it is not economical.

An example of a technique for solving such a problem is disclosed in Patent Documents and the like.

For example, Korean Patent No. 10-1002676 (registered on Dec. 14, 2010, patent document 1) discloses a spring mattress with heating function as shown in FIG. 1. The spring mattress 100 has a plurality of springs spacedly arranged at regular intervals. In the spring mattress 100 has a casing 300 therein having a receiving groove 310 formed therein. A connection part 330 protrudes outwardly from a rear face of the casing. On the left and right sides of the casing, first air inlets 320 are formed. An A/S box 200 is received in the receiving groove 310 of the casing 300 and includes a PTC heater, a blowing fan, and a control unit 210. An air lead pipe 400 is connected at one end thereof to the connection part 330 of the casing 300. The other end of the pipe 400 is connected to the springs 110 via the connection ring 410. The hot air outlet is located inside the spring mattress 100 and does not interfere with the spring 110. The pipe 400 is formed of a flexible material so as to absorb the weight of the user. A second air inlet 220 is formed to position-correspond to the first air inlet 320 when the A/S box 200 is positioned in the casing 300.

Further, Korean Utility Model Registration No. 20-0467271 (registered on May 29, 2013, Patent Document 2) discloses a spring mattress with heating function. The spring mattress has a plurality of springs spacedly arranged at regular intervals. A double-layer nonwoven fabric is provided on each of a top and bottom of the springs. On the double nonwoven fabric provided on the top of the springs, there is a 3D mesh excellent in breathability and cushioning feeling. A sponge is provided on the 3D mesh. A quilted layer is formed on the upper nonwoven fabric. A heat insulating screener is installed across and between the springs contained in the spring mattress and prevents the heating air flowing from a hot air device from leaking to the front, rear, and side faces of the mattress. A rectangular opening is defined to receive the hot air device. A temperature sensor coupled to the hot air device for sensing the temperature of the spring mattress is located between the sponge and the quilted layer.

Further, Korean Patent No. 10-1071367 (registered on Sep., 30, 2011, patent document 3) discloses a spring mattress with heating and cooling function. The spring mattress includes a cold/hot air generating unit having a thermoelectric element and a blower for blowing out the air cooled and heated by the thermoelectric element to the outside; an anion generator unit having an anion generator for generating negative ions and a blower for blowing anions generated by the anion generator to the outside; a control unit for controlling the operation of the hot/cold air generating unit and the negative ion generating unit; and a selection switch for selecting the generation of cold air or hot air or anion. The spring mattress body is enclosed by a ventilated enclosure. A screen of a ventilated fibrous material extends between the front end and the rear end of the main body of the spring mattress and is opened at one side. Air intake and outlet ports are formed on a rear end of the spring mattress body. The air intake port is installed at one side of the screen and the air outlet port is installed at the other side thereof. Connection pipes connect the air inlet and the air outlet ports in the spring mattress and the blowing outlet and the blowing inlet of the hot and cold anion generator respectively so that the cold or hot air and the anion generated from the hot and cold anion generator are circulated in the spring mattress.

SUMMARY

However, in the above-described Patent Document 1, even though the air leader tube 400 made of a flexible material is provided, since the air leader tube 400 is provided from the front end to the rear end of the spring mattress, no warm air is transmitted to the central portion in the longitudinal direction. Therefore, there was a problem that it was not possible to maintain almost the same temperature throughout the spring mattress. That is, since the hot air supplied from the heater is discharged at a high temperature from one end of the spring mattress, the temperature of the hot wind is lowered at the center or the other end of the spring mattress. In addition, when the user uses the spring mattress shown in FIG. 1, there is a problem that hot air is delivered only at the user's head and warm air is not transmitted to the waist.

In the above-described Patent Document 2, the double-layer nonwoven fabric is provided on each of the top and bottom of the springs. On the double nonwoven fabric provided on the top of the springs, there is the 3D mesh excellent in breathability and cushioning feeling. The sponge is provided on the 3D mesh. However, this has a problem in that temperature control cannot be performed sequentially and the temperature cannot be kept constant throughout the spring mattress.

In the above-described Patent Document 3, although the ventilating screen is provided at the central portion of the spring mattress, since the air inlet and the air outlet are provided on both sides of the front portion of the spring mattress respectively, the temperature cannot be controlled uniformly throughout the spring mattress. In other words, the temperature of the air inlet portion becomes higher, but the temperature of the portion of the air outlet is lowered so that the temperature cannot be controlled uniformly throughout the spring mattress.

In addition, in the above-described conventional techniques, the hot air supply part and the control part are mounted at the end of the spring mattress. Thus, when the spring mattress is covered with a bed cover, the control part is not visible.

In one aspect, there is provided a bed device comprising: a support plate; a spring mattress provided on the support plate; a mat provided on the spring mattress; and a hot-air supply device for supplying hot air into the spring mattress, wherein the hot-air supply device is received in the spring mattress, wherein the hot-air supply device includes: a hot-air generation unit for generating hot-air; a hot-air discharge tube protruding from the hot-air generation unit by a predetermined length to discharge the hot-air generated in the hot-air generation unit into the spring mattress; and two hot-air guide members symmetrically disposed about the hot-air discharge tube, wherein the two air guide members are configured to guide the hot-air such that the hot air discharged from the hot-air discharge tube is distributed uniformly over an entire area of the spring mattress.

In one embodiment, each of the two hot-air guide members symmetrically disposed in the spring mattress has an approximately L shape, wherein the combined shape of the two hot-air guide members is approximately U-shaped to surround the hot-air discharge tube.

In one embodiment, the hot-air generation unit includes: a body; air intake holes defined in both sides of the body; an ultraviolet sterilizing lamp provided nearby the air intake holes; control means configured to control functions of the hot-air generation unit; a water container provided in the body for storing water removed from the air sucked through the air intake holes; a heater provided in a front of the hot-air discharge tube; and upper and lower blowing fans provided in front of the heater to discharge the air heated by the heater to the hot-air discharge tube.

In one embodiment, a fluid inflow hole is provided in a rear portion of the container, the fluid inflow hole is covered with a dehumidification plate, and a heat conduction element is mounted on the dehumidification plate, wherein a heat dissipation plate is mounted on the heat conduction element.

In one embodiment, a filter is mounted in each of the air intake holes to purify circulated air in the spring mattress.

In one embodiment, the control means comprises: a main control unit for receiving and processing signals from a remote control unit for remote control; a temperature control unit for controlling a temperature of the heater; a time control unit for controlling an operation time of the heater; a dehumidifying control unit for controlling an operation of the heat conductive element; a drying control unit for controlling a drying state of the air sucked in the air intake holes; a blowing control unit for controlling a rotation speed and a rotation time of the blowing fans; and a sterilization control unit for enabling sterilization of air sucked in the air intake holes by controlling the ultraviolet sterilizing lamp.

In one embodiment, the remote control unit includes: a display unit for displaying a state and an operation state of the control means; a plurality of operation buttons for instructing the control units to control the temperature, speed, time, sterilization, drying, and/or blowing; and an illumination LED module provided above the operation button to allow an user to easily recognize the operation button, wherein the LED module protrudes in a front direction.

In one embodiment, the mat is removably mounted to the spring mattress, wherein the mat has heating function, wherein the mat is configured: to be heated until, via supplying hot-air to an entire spring mattress by a operation of the hot-air supply device, the entire spring mattress reaches a predetermined temperature; and to stop the heating operation thereof when the entire spring mattress reaches the predetermined temperature.

In one embodiment, the mat is removably mounted to the spring mattress, wherein the mat has massaging function, wherein the mat is foldable, and the massage-enabling mat is provided with a plurality of roller massage units which operate independently.

In one embodiment, the support plate is disposed on four support legs, wherein each of the support legs includes: a support hollow frame; upper and lower support plates spacedly disposed in the support frame; a shock absorber disposed between the upper and lower support plates, wherein the shock absorber includes a shock absorber body beneath the upper plate, and a coil spring disposed between the shock absorber body and the lower support plate; and a bottom leg portion integrated with the lower support plate.

First, according to the spring bed device with heating function according to the present invention, the two hot-air guide members may be symmetrically disposed about the hot-air discharge tube, wherein the two air guide members are configured to guide the hot-air such that the hot air discharged from the hot-air discharge tube is distributed uniformly over an entire area of the spring mattress. In this way, this allows hot-air and heat to be supplied throughout the surface of the spring mattress, like a traditional heated flat stone system.

In addition, according to the spring bed device with heating function according to the present invention, the air sucked through the air intake holes is dehumidified. Thus, the hot-air circulating in the spring mattress can be kept in an optimal state.

Further, according to the spring bed device with heating function according to the present invention, the pair of blowing fans is provided for hot-air supply. This prevents vortices between the heater and the blowing fans, and maintains the heated hot air at a constant temperature.

Moreover, according to the spring bed device with heating function according to the present invention, by providing the filter and the ultraviolet sterilizing lamp in the spring mattress to purify the circulating air, mites and the like present in the spring mattress can be collected and sterilized.

Finally, according to the spring bed device with heating function according to the present invention, by providing the LED module in the remote control unit, the user can easily operate the operation button without a separate illumination device even when sleeping at night.

DETAILED DESCRIPTIONS

These and other objects and novel features of the present invention will become more apparent from the description of the present specification and the accompanying drawings.

Spatially relative terms, such as "beneath," "below," "lower," "under," "above," "upper," and the like, may be used herein for ease of explanation to describe one element or feature's relationship to another element or feature as illustrated in the figures.

For example, if the device in the figures is turned over, elements described as "below" or "beneath" or "under" other elements or features would then be oriented "above" the other elements or features. It will be understood that the spatially relative terms are intended to encompass different orientations of the device in use or in operation, in addition to the orientation depicted in the figures.

Hereinafter, the configuration of the present invention will be described with reference to the drawings.

Figure 1:
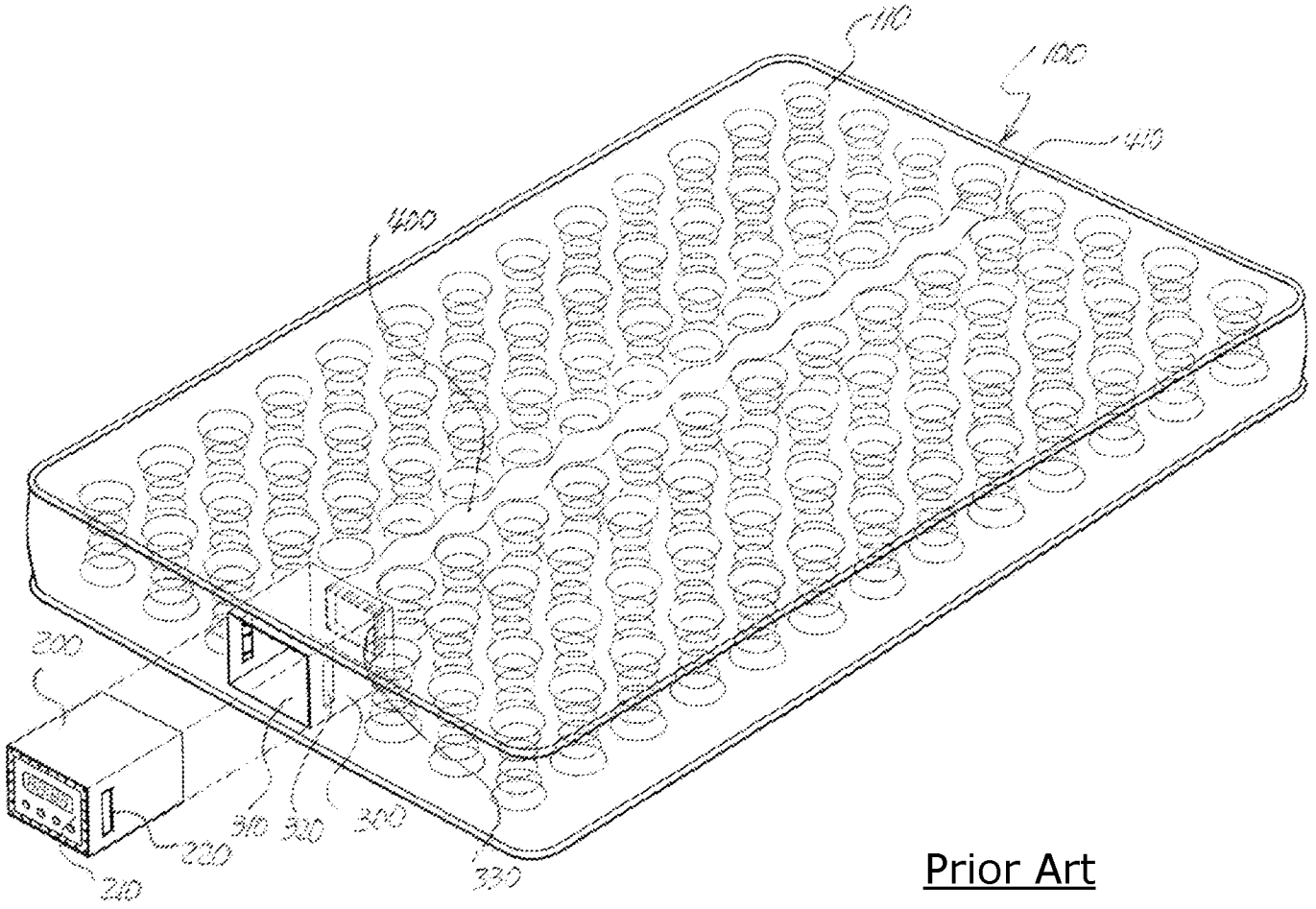
Prior Art FIG. 1
FIG. 1 is a perspective view of a spring mattress having a conventional heating function.
Figure 2:
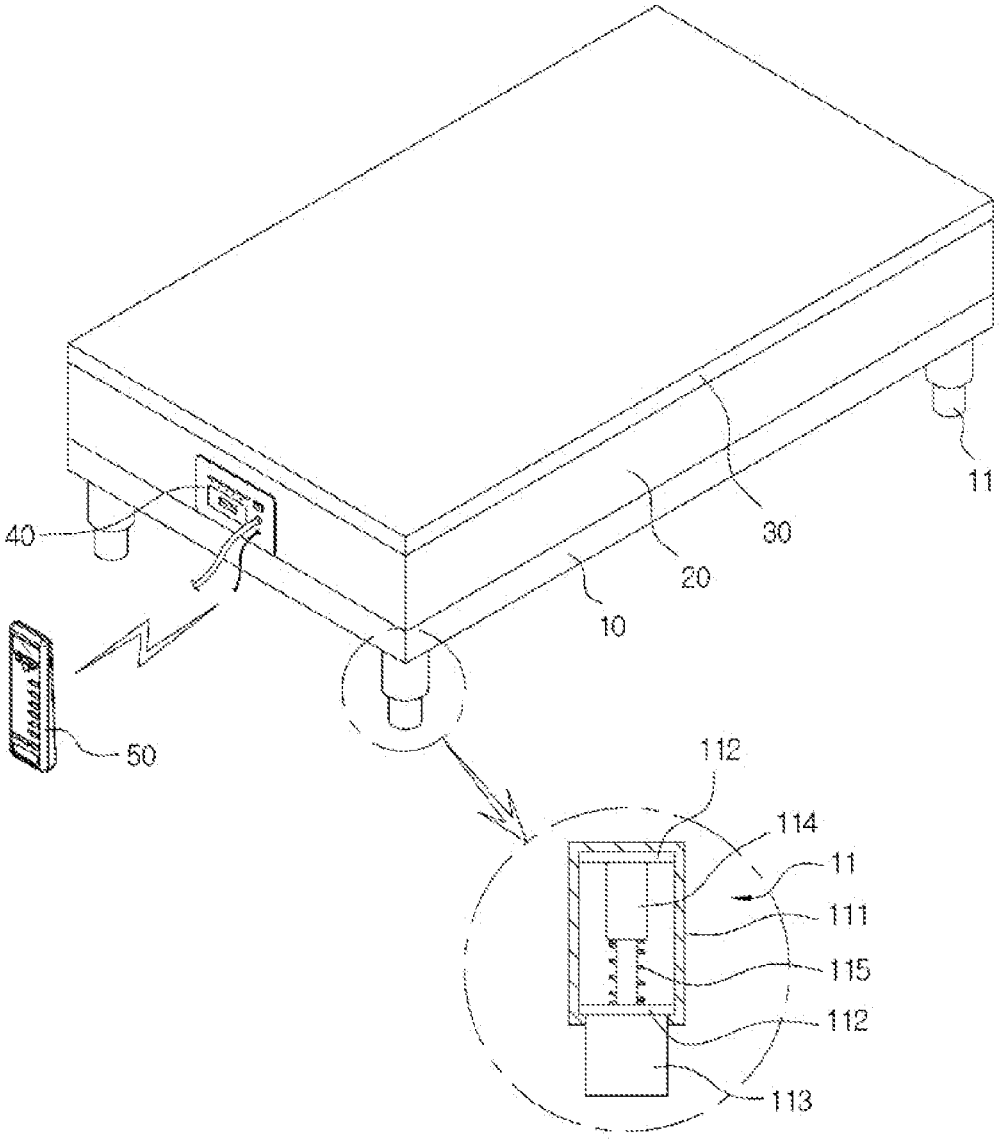
FIG. 2 is a perspective view of a spring bed device with heating function according to the present invention.
Figure 3:
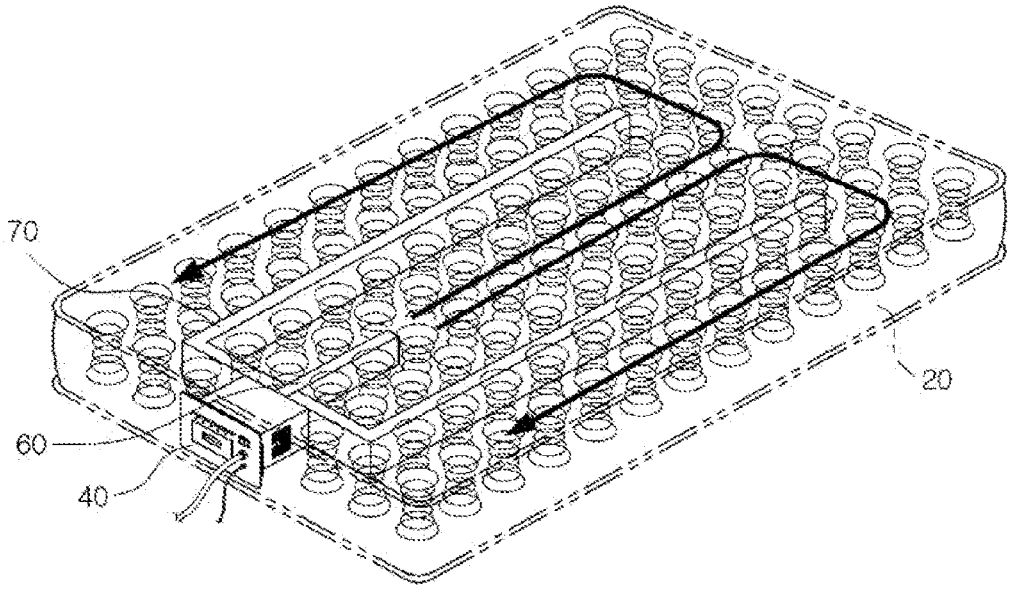
FIG. 3 is a perspective view showing an internal structure of a spring mattress according to the present invention.

FIG. 2 is a perspective view of the spring bed device with heating function according to the present invention. FIG. 3 is a perspective view illustrating the internal structure of the spring mattress 20 according to the present invention.

As shown in FIGS. 2 and 3, the bed device according to the present invention includes the spring mattress 20 provided on a support plate 10, and a mat 30 provided on the spring mattress 20. In the spring mattress 20, a hot-air supply device for supplying hot air into the spring mattress is installed. The hot-air supply device includes a hot-air generation unit 40 for generating hot-air, a remote control unit 50 for remote controlling of the hot-air generation unit 40, a hot-air discharge tube 60 protruding from the hot-air generation unit 40 by a predetermined length to discharge the hot-air generated in the hot-air generation unit 40 into the spring mattress 20, and two symmetrical hot-air guide members 70 symmetrically provided at both sides of the hot-air discharge tube 60 respectively, wherein the two hot-air guide members 70 are configured to guide the hot-air such that the hot air discharged from the hot-air discharge tube 60 is distributed uniformly over an entire area of the spring mattress 20.

As shown in FIG. 2, the support plate 10 is disposed on four support legs 11. Each of the support legs 11 includes a steel support frame 111, upper and lower support plates 112 disposed in the support frame 111, a shock absorber 114 disposed between the upper and lower support plates 112, wherein the shock absorber 114 includes a shock absorber body beneath the upper plate 112, and a coil spring 115 disposed between the shock absorber body and the lower support plate 112, and a bottom leg portion 113 integrated with the lower support plate 112.

Thus, even when the spring mattress 20 is subjected to a heavy load, the shock absorber 114 may buffer the entire bed device, thereby preventing damage to the spring mattress 20.

As shown in FIG. 3, the spring mattress 20 according to the present invention has an array of springs spacedly arranged at regular intervals therein. The spring mattress 20 is configured to have a sealed space from the outside. In this way, hot air may be supplied between the springs and may be circulated therein.

Each of the two hot-air guide members 70 symmetrically disposed in the spring mattress 20 has an approximately L shape. Thus, the combined shape of the two hot-air guide members 70 is approximately U-shaped. In one embodiment, the combined shape of the two hot-air guide members 70 may be formed to surround the hot-air discharge tube 60. That is, the two hot-air guide members 70 may be symmetrically disposed about the hot-air discharge tube 60. As shown in FIG. 3, each of the hot-air guide members 70 has a transversal portion corresponding to about a quarter of the width of the spring mattress 20 and have a longitudinal portion smaller than an overall length of the spring mattress 20.

Thus, the hot-air discharged from the hot-air discharge tube 60 may be guided via the hot-air guide members 70 to the rear of the spring mattress 20, as indicated by arrows in FIG. 3. Then, the hot-air turns around the distal end of each of the hot-air guide members 70 and returns to the hot-air generation unit 40. By providing the hot-air guide members 70, the hot-air may be uniformly distributed and circulated over and within the entire area of the spring mattress 20.

The mat 30 is removably mounted to the spring mattress 20. In one embodiment, the mat 30 may be fabricated integrally with the spring mattress 20. In one embodiment, the mat 30 may be separately fabricated with the spring mattress 29 and subsequently and be operatively mounted on the spring mattress 20. The structure and function of the mat 30 will be described later.

As shown in FIG. 3, the hot-air discharge tube 60 may be formed in a rectangular shape so as to incorporate the hot-air generation unit 40 therein. In one example, the tube 60 may protrude by approximately 30 cm.

Next, the structure of the hot-air generation unit will be described with reference to FIGS. 4 and 5.

Figure 4:
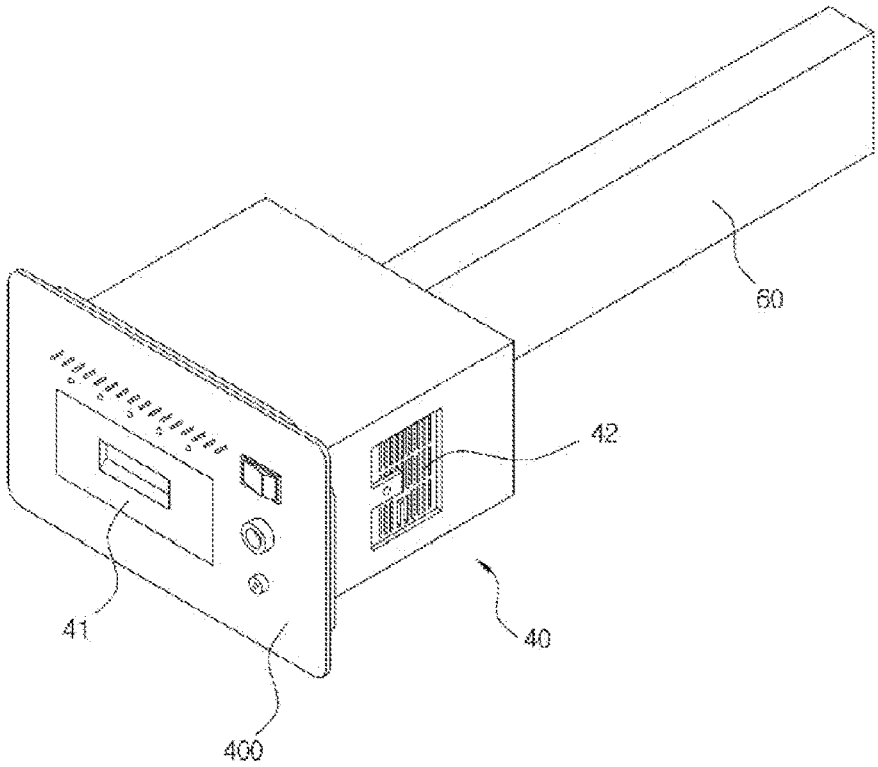
FIG. 4 is a perspective view showing an appearance of a hot-air generation unit shown in FIG. 3.

FIG. 4 is a perspective view showing an appearance of the hot-air generation unit 40 shown in FIG. 3. FIG. 5 is a cross-sectional view showing an example of the internal structure of the hot-air generation unit shown in FIG. 4.

As shown in FIG. 4, the hot-air generation unit 40 includes: a body 400 made of a metal material, a water container 41 provided at the front of the body for storing water removed from the air sucked through air intake holes, air intake holes 42 provided in both sides of the body, a heater 43 provided in the front of the hot-air discharge tube 60, a pair of blowing fans 44 provided in front of the heater 43 to discharge the air heated by the heater 43 to the hot-air discharge tube 60, and a control unit for controlling the respective functions of the hot-air generation unit 40.

Figure 5:
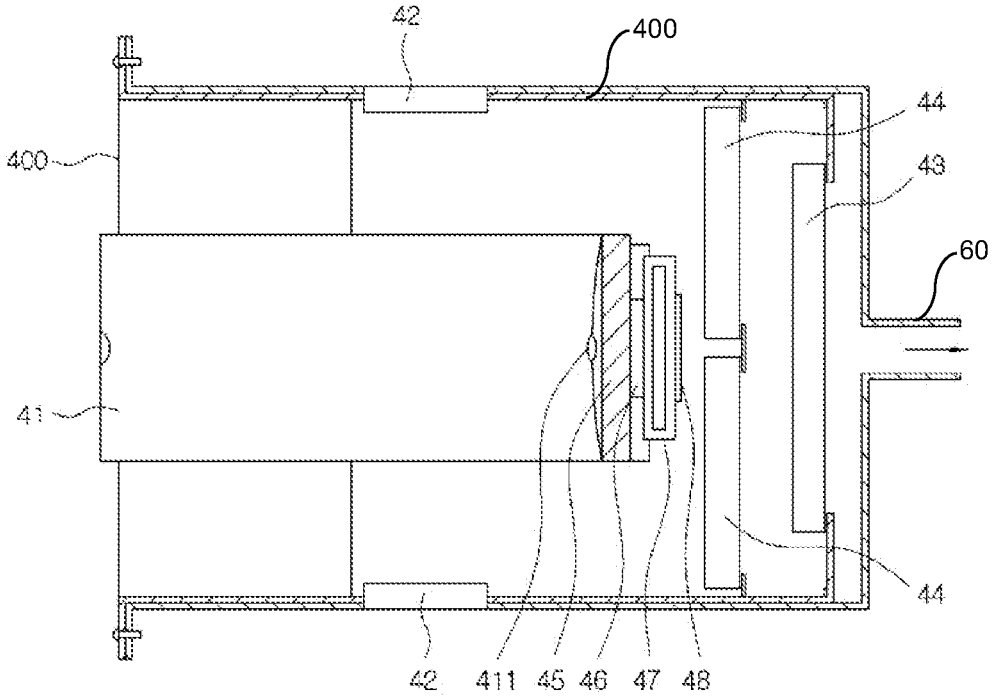
FIG. 5 is a sectional view showing an example of an internal state of a hot-air generation unit shown in FIG. 4.

The body 400 is formed in a box shape as shown in FIG. 5. Each of the components of the hot-air generation unit 40 described above is accommodated in the body 400. The body 400 is inserted into the hot-air discharge tube 60. In addition, the body 400 is fixed to the hot-air discharge tube 60 by fastening means such as bolts, as shown at the top and bottom in FIG. 5.

As shown in FIG. 4, a plurality of LED display units to indicate the operation state of the hot-air generation unit 40, a power supply and shutoff switch, a terminal for connecting a power line and a control line may be mounted on the front surface of the body 400.

The air intake holes 42 are provided on both sides of the body 400, as shown in FIG. 5. The air intake holes 42 suck hot-air which is discharged from the hot-air discharge tube 60 and then returns via the hot-air guide members 70 toward the hot-air generation unit 40. Further, a filter is mounted in the air intake holes 42 to clean the circulated air in the spring mattress 20. To this end, the hot-air discharge tube 60 is also provided with through-holes communicating with the air intake holes 42 respectively.

By providing the filter in the air intake holes 42, dust is removed from the circulated air in the spring mattress 20. As a result, it is possible to prevent dust from accumulating on the heater 43 and the blowing fans 44. This filter also acts as a mesh to collect mites present in the spring mattress 20. Thus, it is possible to prevent the occurrence of allergies and promote the health of the user.

On the front of the water container 41, a handle is provided as shown in FIG. 4. As shown in FIG. 5, a fluid inflow hole 411 is provided in the rear of the container 41. The fluid inflow hole 411 is covered with a dehumidification plate 45. The dehumidification plate 45 is provided with a heat conduction element 46, and the heat conduction element 46 is fitted with a heat dissipation plate 47. The dehumidification plate 45, the heat conduction element 46, and the heat dissipation plate 47 are provided as one module. The module is coupled to the body by a support 48 and is held within a substantially central portion of the body.

As described above, by providing the dehumidification plate 45, it is possible to remove moisture from the air supplied to the blowing fans 44. As a result, the efficiency of the heater 43 can be maximized. The moisture dehumidified by the dehumidification plate 45 is stored in the water container 41 through the fluid inflow hole 411.

In addition, by providing the pair of blowing fans 44, the hot air generated by the heater 43 can be optimally discharged to the hot-air discharge tube 60. In the present embodiment, hot air is supplied in an internal circulation manner. As a result, the air that reaches the blowing fans 44 again becomes hot-air. For this purpose, it is preferable that the blowing fans 44 are made of high strength synthetic resin or metallic material.

Next, control means provided in the hot-air generation unit 40 according to the present invention will be described with reference to FIG. 6 to FIG. 8.

Figure 6:
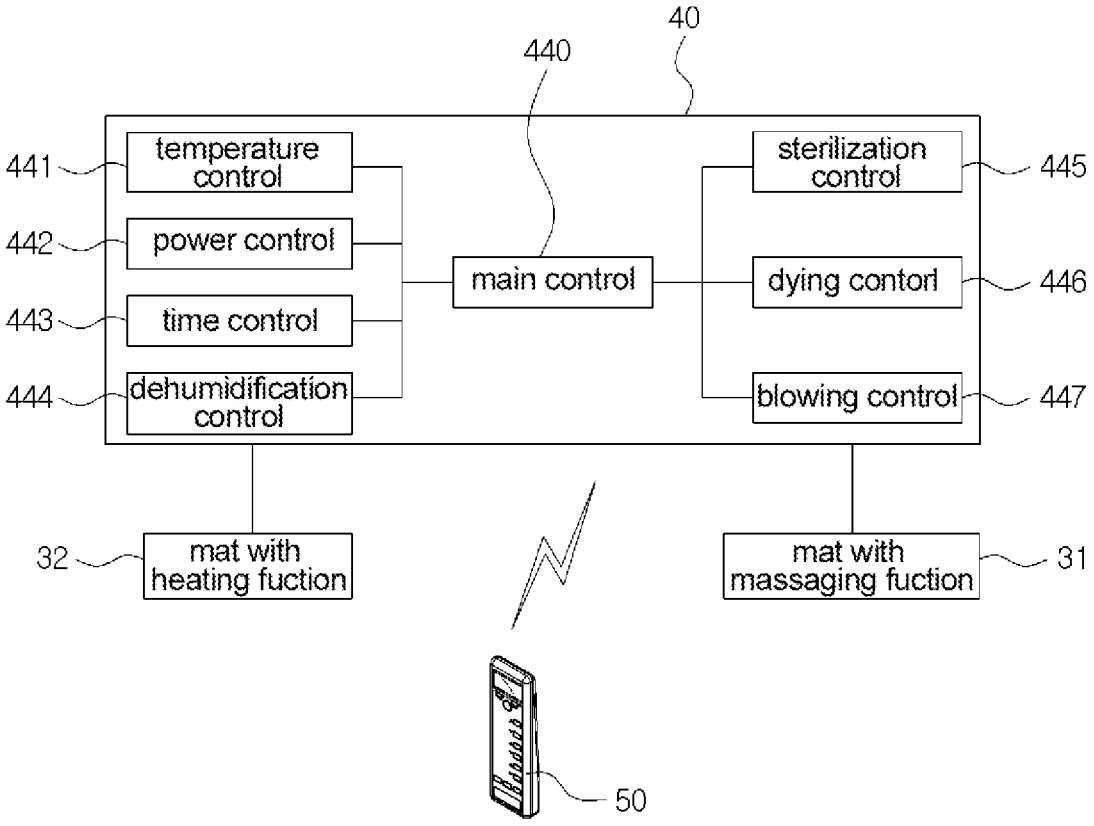
FIG. 6 is a block diagram of a hot-air generation unit shown in FIG. 4.

FIG. 6 is a block diagram of a hot-air generation unit shown in FIG. 4. FIG. 7 is a perspective view of a remote control unit for controlling a hot-air generation unit in a spring bed device with heating function according to the present invention. FIG. 8 is a diagram showing a state in which a control example of a remote control unit shown in FIG. 7 is displayed on a display unit.

The control means comprises: a main control unit 440 for receiving and processing signals from the remote control unit 50 for remote control, a temperature control unit 441 for controlling the temperature of the heater 43, a power supply control unit 442 for adjusting the power supplied to the heater 43, a time control unit 443 for controlling the operation time of the heater 43, a dehumidifying control unit 444 for controlling the operation of the heat conductive element 46, a sterilization control unit 445 for controlling the sterilization of the air sucked in the air intake holes 42, a drying control unit 446 for controlling the drying state of the air sucked in the air intake holes 42, and a blowing control unit 447 for controlling the rotation speed and the rotation time of the pair of blowing fans 44.

The main control unit 440 controls the operation of a massage-enabling mat 31 or a heating unit 32 provided in the mat 30. To this end, the main control unit 440 includes a memory and a processor. The memory stores preset conditions for each component as described above. The processor receives and processes the settings stored in the memory and commands transmitted from the remote control unit 50.

Basically, the present bed device is assumed to be operated by the main control unit 400 in response to an operation command of the remote control unit 50. However, the present invention is not limited thereto. It is also possible to adopt a configuration in which an operation panel is provided on the front surface of the body 400 and the main control unit 441 is controlled by the operation panel.

The temperature control unit 441 senses the temperature of the surface of the spring mattress 20 and controls the temperature of the heater 43 based on the command value from the remote control unit 50. In one embodiment, the temperature may be adjusted from 0° C. up to 60° C. in 1 degree increments. The set temperature value is displayed on the display unit 51 of the remote control unit 50 as shown in FIG. 8. By this temperature setting, the intensities of the heater 43 and the blowing fans 44 may be controlled in an associated manner.

The power control unit 442 controls the rotation speed of the blowing fans 44 in response to the temperature controlled by the temperature control unit 441. Alternatively, the power supply control unit 442 controls the current applied to the heater 43 to control the hot-air generation temperature in the heater 43.

The time control unit 443 is inter-operated with the temperature control unit 441. The time control unit 443 enables the user to set the operation time of the heater 43. In this manner, the operation time of the heater 43 may be set such that the heater is continuously operated for example, for 10 hours, every 30 minutes under the control of the time control unit 443. The thus-set state is displayed on the display unit 51 of the remote control unit 50.

The dehumidification control unit 444 controls the operation of the heat conduction element 46. In addition, the control unit 444 allows the remote control unit 50 to be informed of a full status when the dehumidified water is full in the water container 41.

In one embodiment, an ultraviolet sterilizing lamp may be installed in the air intake holes 42 to sterilize the air sucked in the air intake holes 42 for a period of time. In this regard, when the ultraviolet sterilizing lamp is driven, the sterilizing control unit 445 adjusts the rotational speed of the blowing fans 44 to a high level, thereby sterilizing air circulating the spring mattress 20 for a predetermined time. In this embodiment, by providing the filter and the ultraviolet germicidal lamp in the air intake holes 42, mites and the like present in the spring mattress 20 can be collected and sterilized.

The drying control unit 446 controls the drying state of the air sucked in the air intake holes 42. In one embodiment, to optimize the air circulation within the spring mattress 20, it may be desirable to operate the blowing fans at a high level for a period of time, for example, for 60 minutes, to maintain the air at a constant temperature, for example 60° C. Thus, by operating the drying control unit 446, the circulating air in the spring mattress 20 may be kept in an optimal state during the humid season, for example during the summer rainy season.

The blowing control unit 447 may be cooperated with the sterilizing control unit 445, and the drying control unit 446. The blowing control unit 447 is provided to control the rotation speed and the rotation time of the pair of blowing fans 44. In an embodiment, for example, noise due to the operation of the blowing fans 44 is generated. To solve this problem, a speed level may be divided into eight degrees to control the speed of the blowing fans 44 based on a corresponding degree.

Figure 7:
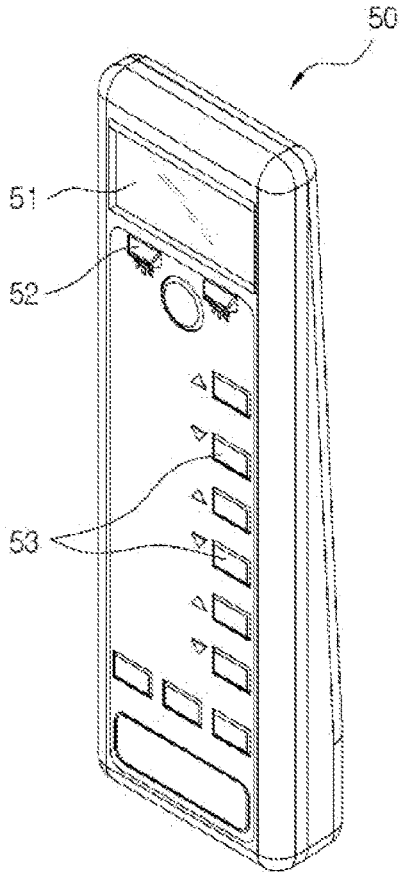
FIG. 7 is a perspective view of a remote control unit for controlling a hot-air generation unit in a spring bed device with heating function according to the present invention.

As shown in FIG. 7, the remote control unit 50 includes a display unit 51 for displaying the state and operation state of the control means, and a plurality of operation buttons 53 for controlling the temperature, speed, time, sterilization for the control units. An illumination LED module 52 is provided above the operation button 53 to easily recognize the operation button 53 by the user at night. As shown in FIG. 2, the LED module 52 protrudes in a front direction, and is turned on when any one of the operation buttons 53 is pressed.

By providing the LED module 52 in this way, the user may operate the operation button 53 easily without a separated illumination apparatus during nighttime sleep. In addition, the LED module 52 is provided for allowing the user to easily recognize the operation button 53. Therefore, the LED module 52 may be automatically turned on or off at an given interval, for example, an interval of 3 to 5 seconds, at which the user can recognize each of the operation button 53.

Figure 8:
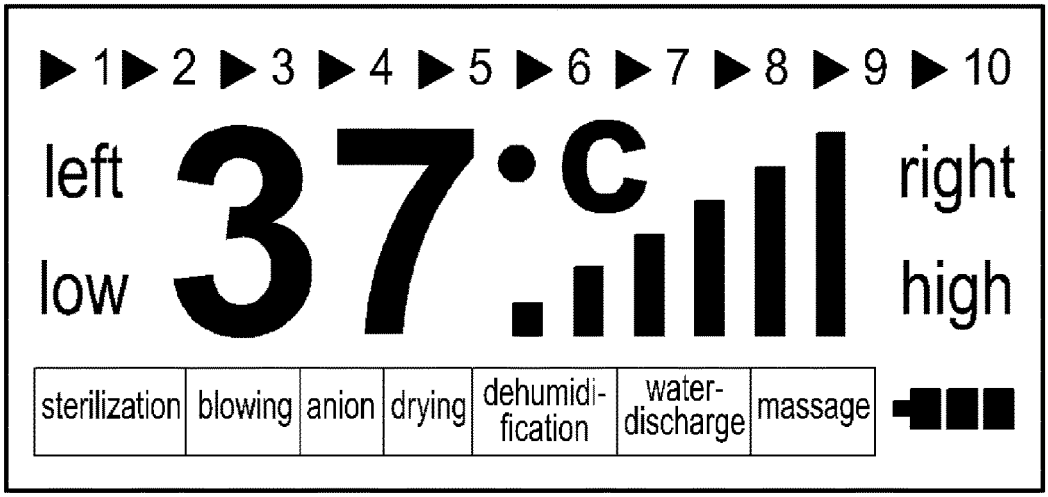
FIG. 8 is a diagram showing a state in which a control example of a remote control unit shown in FIG. 7 is displayed on a display unit.

The control state by each control unit as shown in FIG. 6 is displayed on the display unit 51 as shown in FIG. 8. In addition, the display unit 51 is provided with a remaining battery level indicator that indicates the remaining battery level.

In addition, the remote control unit 50 may be provided with a speaker for outputting a warning sound that can be recognized by the user when an abnormality occurs in each control state. In addition, the remote control unit 50 may have a voice recognition function so that the user can easily recognize the position of the remote control unit 50 at night. In this way, a sound signal may be output in accordance with the user's voice.

Next, the massage-enabling mat 31 shown in FIG. 6 will be described with reference to FIG. 9.

Figure 9:
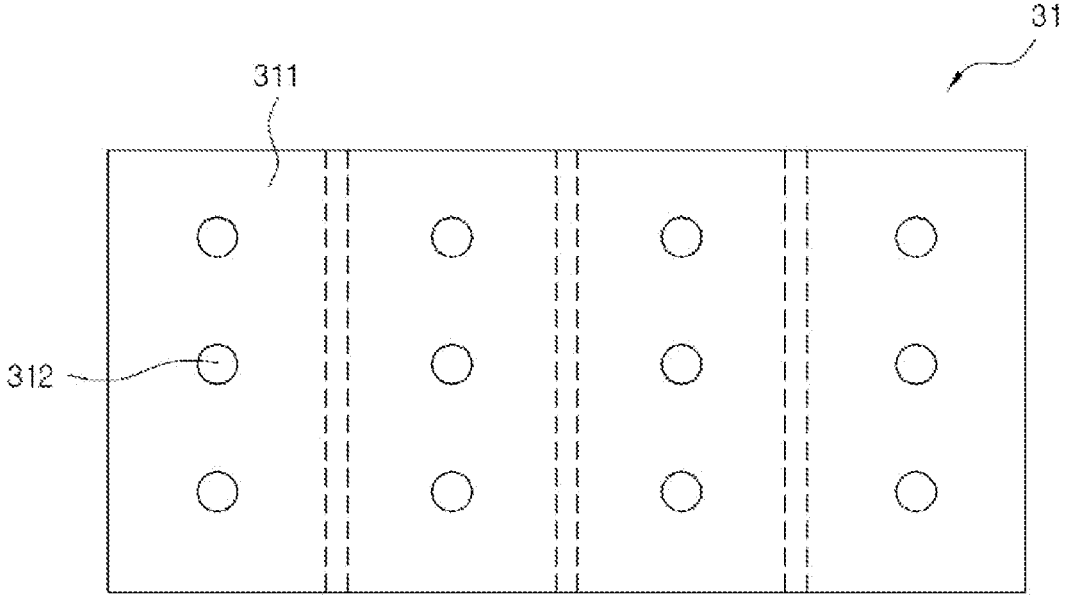
FIG. 9 is a perspective view showing an example of a configuration of a mat provided on a spring mattress according to the present invention.

FIG. 9 is a perspective view illustrating an example of the configuration of the mat provided on the spring mattress according to the present invention.

The massage-enabling mat 31 shown in FIG. 9 may be folded in four stages, for example. The mat 31 is detachably mounted to the spring mattress 20.

The massage-enabling mat 31 is provided with a plurality of roller massage units 312 which operate independently of a mat body 311.

The plurality of roller massage units 312 are independently controlled by the main control unit 440. Each massage unit is connected to an output shaft driven by independent motor so that the massage unit 312 is moved up and down by the rotation of the motor to exert a massage effect. A detailed operation of the message unit 312 is disclosed for example, in Korean Utility Model Registration No. 20-0414889. Thus, the detailed description thereof will be omitted.

Next, the mat 32 with heating function shown in FIG. 6 will be described with reference to FIG. 10.

Figure 10:
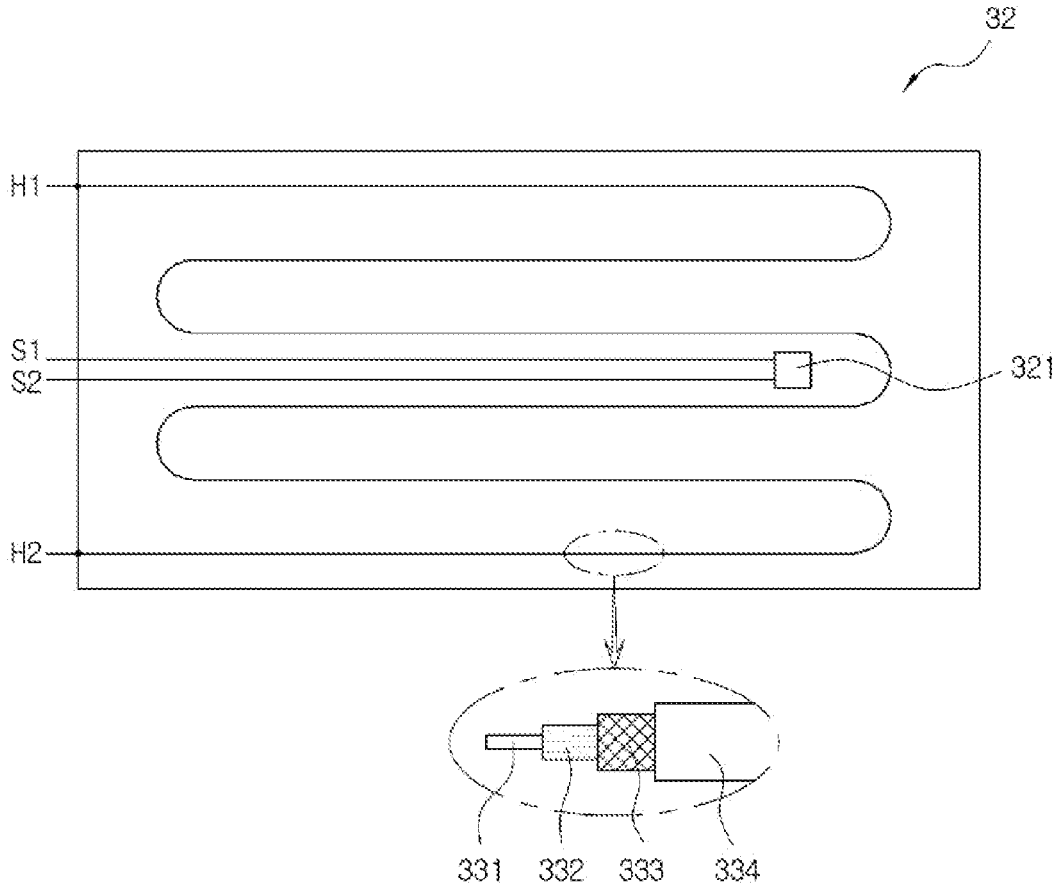
FIG. 10 is a perspective view showing another example of a construction of a mat provided on a spring mattress according to the present invention.

FIG. 10 is a perspective view showing another example of the construction of the mat provided on the spring mattress according to the present invention.

The mat 32 with heating function shown in FIG. 10 is removably mounted to the spring mattress 20. The mat 32 with heating function is heated until, by supplying hot-air to the entire spring mattress by the operation of the hot-air supply device, the entire spring mattress reaches a predetermined temperature. When the spring mattress 20 reaches the predetermined temperature, the heating operation of the mat 32 is stopped. To this end, a sensor 321 is provided in the heating function with the mat 32.

As shown in FIG. 10, heater lines H1 and H2 and sensor sensing lines S1 and S2 are provided in the mat 32 with heating function. Each of the heater lines H1 and H2 includes a heater heat line 331, a silicon inner coat 332 covering the heater heat line 331, a silicon shielding portion 333 provided outside the silicon inner coat and formed in a net shape by a copper wire, and a silicon outer coat 334 covering the shielding portion 333. However, the present invention is not limited thereto. A silver-foil shield may be provided between the silicon inner coat 332 and the shielding portion 333.

Moreover, the mat 32 with the heating function may include a spark ignition preventing means to prevent spark due to the disconnection of the heater lines H1 and H2, heater overheat prevention means to prevent overheat due to sensor disconnection, a long-time overheating prevention means to prevent long-time overheating due to a timer failure, display means for digitally displaying the temperature setting and the current temperature, and a control unit for controlling the spark ignition preventing means, the heater overheating preventing means, and the long time overheating preventing means, respectively. The spark ignition preventing means, the heater overheating preventing means, and the long-time overheating preventing means may be simultaneously executed to realize the triple safety control. The spark ignition preventing means includes first and second triac elements, and first and second phototransistors optically coupled to the first and second triac elements, respectively. The first and second triac elements are respectively connected to a first heater line and a second heater line. The spark ignition preventing means may be configured such that, when a break occurs in any one of the heater lines H1 and H2, information on the disconnection state of the heater line is transmitted to the control unit via the first and second phototransistors. A power supply unit thereof may be provided with a fuse.

Although the present invention has been described in detail with reference to the above embodiments, it is needless to say that the present invention is not limited to the above-described embodiments, and various modifications may be made without departing from the scope of the present invention.

INDUSTRIAL AVAILABILITY

By using the bed device according to the present invention, the hot-air may be uniformly distributed over the entire surface of the spring mattress.

What is claimed is:

1. A bed device comprising:

a support plate;

a spring mattress provided on the support plate;

a mat provided on the spring mattress; and a hot-air supply device for supplying hot air into the spring mattress, wherein the hot-air supply device is received in the spring mattress, wherein the hot-air supply device includes:

a hot-air generation unit for generating hot-air;

a hot-air discharge tube protruding from the hot-air generation unit by a predetermined length to discharge the hot-air generated in the hot-air generation unit into the spring mattress; and two hot-air guide panel members symmetrically disposed about the hot-air discharge tube, wherein the two air guide panel members are configured to guide the hot-air such that the hot air discharged from the hot-air discharge tube is distributed uniformly over an entire area of the spring mattress, wherein the hot-air generation unit includes:

a body;

air intake holes defined in both sides of the body;

an ultraviolet sterilizing lamp provided nearby the air intake holes; and control means configured to control functions of the hot-air generation unit, wherein the control means includes a sterilization control unit for enabling sterilization of air sucked in the air intake holes by controlling the ultraviolet sterilizing lamp, wherein each of the two hot-air guide panel members symmetrically disposed in the spring mattress has an approximately L shape, and the combined shape of the two hot-air guide panel members is approximately U-shaped to surround the hot-air discharge tube, wherein the hot-air generation unit comprises:

a water container provided in the body for storing water removed from the air sucked through the air intake holes;

a heater provided within the body, the heater being in front of the hot-air discharge tube; and upper and lower blowing fans provided within the body, the upper and lower blowing fans being in front of the heater to discharge the air heated by the heater to the hot-air discharge tube, and wherein a fluid inflow hole is provided in a rear portion of the container, wherein the fluid inflow hole is covered with a dehumidification plate, wherein a heat conduction element is mounted on the dehumidification plate, wherein a heat dissipation plate is mounted on the heat conduction element.

2. The bed device of claim 1, wherein a filter is mounted in each of the air intake holes to purify circulated air in the spring mattress.

3. The bed device of claim 1, wherein the control means further comprises:

a main control unit for receiving and processing signals from a remote control unit for remote control;

a temperature control unit for controlling a temperature of the heater;

a time control unit for controlling an operation time of the heater;

a dehumidifying control unit for controlling an operation of the heat conductive element;

a drying control unit for controlling a drying state of the air sucked in the air intake holes; and a blowing control unit for controlling a rotation speed and a rotation time of the blowing fans.

4. The bed device of claim 3, wherein the remote control unit includes:

a display unit for displaying a state and an operation state of the control means;

a plurality of operation buttons for instructing the control units to control the temperature, speed, time, sterilization, drying, and/or blowing; and an illumination LED module provided above the operation button to allow an user to easily recognize the operation button, wherein the LED module protrudes in a front direction.

5. The bed device of claim 1, wherein the mat is removably mounted to the spring mattress, wherein the mat has heating function, wherein the mat is configured:

to be heated until, via supplying hot-air to an entire spring mattress by a operation of the hot-air supply device, the entire spring mattress reaches a predetermined temperature; and to stop the heating operation thereof when the entire spring mattress reaches the predetermined temperature.

6. The bed device of claim 1, wherein the mat is removably mounted to the spring mattress, wherein the mat has massaging function, wherein the mat is foldable, and the massage-enabling mat is provided with a plurality of roller massage units which operate independently.

7. The bed device of claim 1, wherein the support plate is disposed on four support legs, wherein each of the support legs includes:

a support hollow frame;

upper and lower support plates spacedly disposed in the support frame;

a shock absorber disposed between the upper and lower support plates, wherein the shock absorber includes a shock absorber body beneath the upper plate, and a coil spring disposed between the shock absorber body and the lower support plate; and a bottom leg potion integrated with the lower support plate.

* * * * *